United States Patent [19]

Clipson et al.

[11] 4,015,713

[45] Apr. 5, 1977

[54] STACKABLE STORAGE BIN

[75] Inventors: Stuart A. Clipson, Glendale; Jack L. Lemkin, Cincinnati, both of Ohio

[73] Assignee: Midland-Ross Corporation, Cleveland, Ohio

[22] Filed: May 23, 1975

[21] Appl. No.: 580,217

[52] U.S. Cl. ..... 206/509; 211/126

[51] Int. Cl.[2] ..... B65D 21/02

[58] Field of Search ..... 206/509; 211/126, 128

[56] References Cited

UNITED STATES PATENTS

| | | | |
|---|---|---|---|
| 3,246,795 | 4/1966 | Stubbe | 206/509 |
| 3,252,614 | 5/1966 | Evans | 206/509 |
| 3,259,269 | 7/1966 | Asenbauer | 206/509 |
| 3,278,249 | 10/1966 | Howe | 206/509 |
| 3,347,394 | 10/1967 | Gould | 206/509 |

FOREIGN PATENTS OR APPLICATIONS

| | | | |
|---|---|---|---|
| 97,123 | 5/1958 | Denmark | 206/509 |
| 361,239 | 5/1962 | Switzerland | 206/509 |

*Primary Examiner*—George E. Lowrance
*Attorney, Agent, or Firm*—H. Duane Switzer

[57] ABSTRACT

A stackable storage bin includes abutment means for inhibiting forward sliding movement and vertical separation of an upper bin stacked upon a lower bin.

2 Claims, 5 Drawing Figures

STACKABLE STORAGE BIN

BACKGROUND OF THE INVENTION

This application pertains to the art of stackable storage bins and, more particularly, to such bins having abutment means for inhibiting sliding movement of an upper bin stacked upon a lower bin.

Stackable storage bins of known types include those disclosed in U.S. Pats. Nos. 3,163,319 issued Dec. 29, 1964, to Mauser; 3,252,614 issued May 24, 1966, to Evans; 3,259,269 issued July 5, 1966, to Asenbauer; and 3,347,394 issued Oct. 17, 1967, to Gould.

Stackable storage bins of the type described are commonly provided with abutment means for inhibiting forward sliding movement of an upper bin stacked upon a lower bin. In previous arrangements, an upper bin can easily be vertically separated from a lower bin so the abutment means is rendered ineffective if the upper bin is tilted or if sufficient horizontal force is applied to allow the upper bin to ride over the abutments.

SUMMARY OF THE INVENTION

A stackable storage bin of the type described has abutment means for inhibiting forward sliding movement of an upper bin relative to a lower bin and for inhibiting vertical separation of the bins.

The bin includes rear and opposite sidewalls extending upwardly from a bottom wall. A slight draft angle of at least one degree is provided for the rear and sidewalls so they slope outwardly. The sidewalls are stepped outwardly adjacent their top edges to provide support shoulders on which the bottom outer edge portions of an upper bin are supportable. First abutment means extends inwardly from the sidewalls adjacent the shoulders and second abutment means extends outwardly from the sidewalls adjacent the bottom wall.

In one arrangement, the first abutment means is located intermediate the shoulders and the top edges of the sidewalls. Outwardly extending flanges adjacent the bin bottom are receivable between the first abutment means and the shoulders for inhibiting vertical separation of stacked bins. A generally vertically extending abutment projection adjacent the bottom wall is positionable closely adjacent the first abutment means, and between such first abutment means and the rear wall, for inhibiting forward sliding movement of an upper bin relative to a lower bin.

It is a principal object of the present invention to provide an improved stackable storage bin.

It is another object of the invention to provide a stackable storage bin with abutment means for inhibiting forward sliding movement of an upper bin relative to a lower bin and for inhibiting vertical separation of stacked bins.

A further object of the invention is to provide a stackable storage bin wherein an upper bin is supported along the full length of its opposite bottom side edge portions on upper support shoulders of a lower bin.

DESCRIPTION OF A PREFERRED EMBODIMENT

Figure 2:
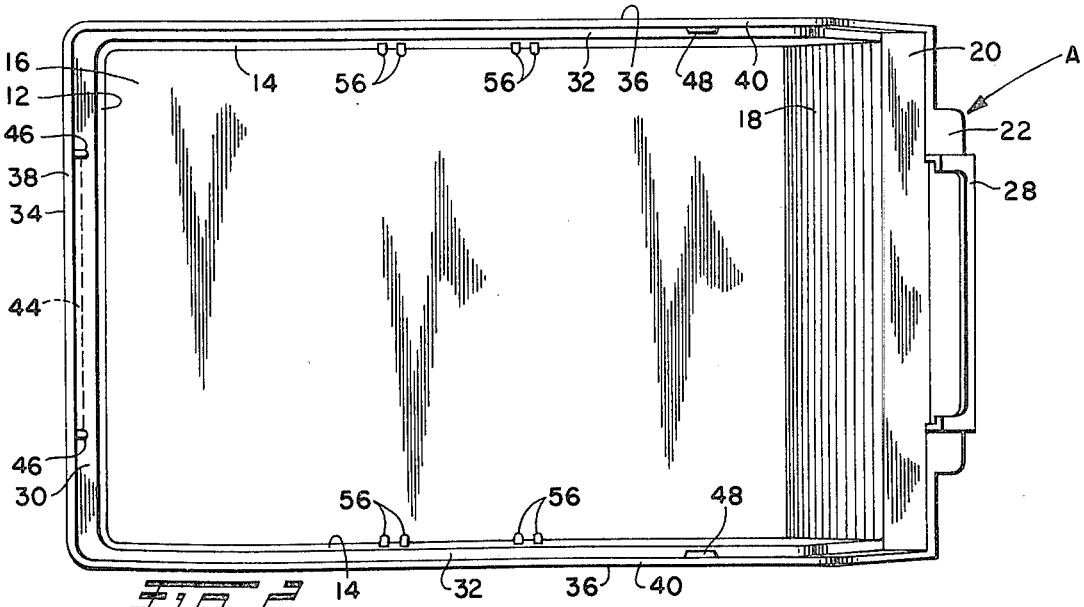
FIG. 2 is a top plan view looking generally in the direction of arrows 2—2 of FIG. 1.
Figure 1:
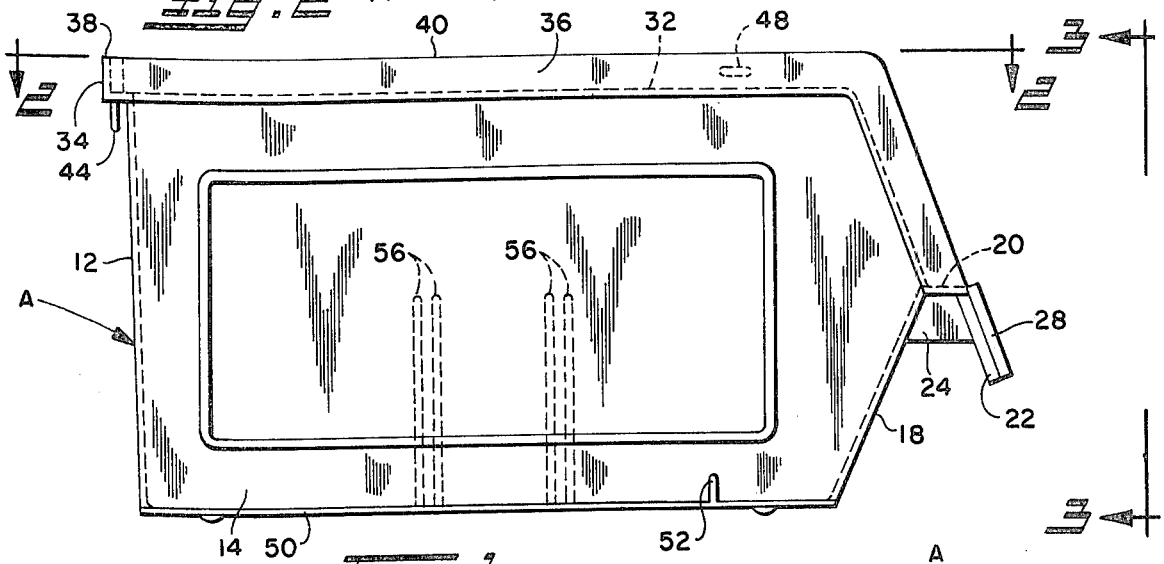
FIG. 1 is a side elevational view of a storage bin having the features of the present invention incorporated therein.
Figure 3:
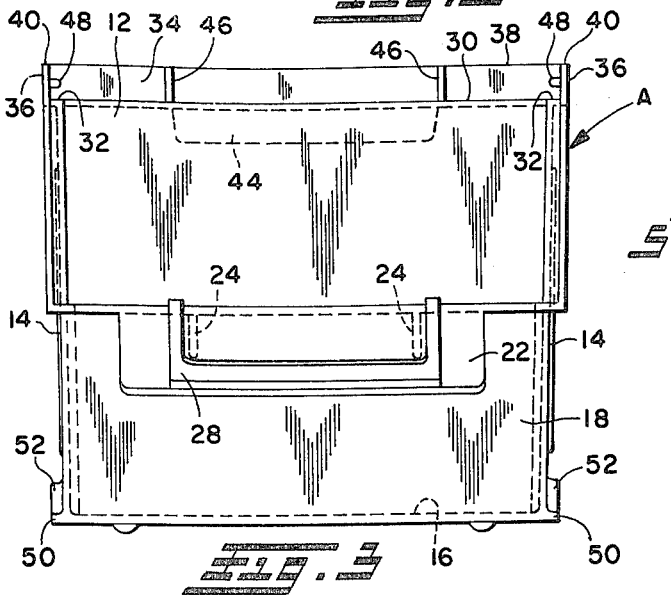
FIG. 3 is a front elevational view looking generally in the direction of arrows 3—3 of FIG. 1.
Figure 4:
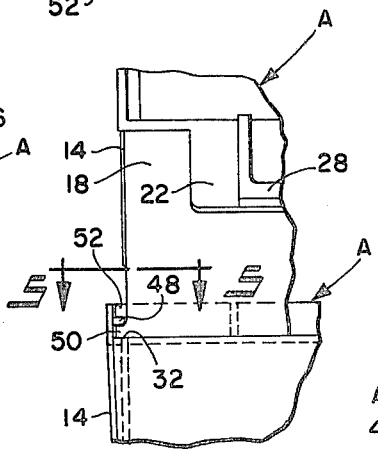
FIG. 4 is a partial front elevational view showing an upper bin stacked upon a lower bin.
Figure 5:
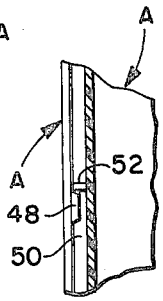
FIG. 5 is a partial cross-sectional plan view looking generally in the direction of arrows 5—5 of FIG. 4.

With reference to the drawing, FIG. 1 shows a stackable storage bin A molded in one-piece of any suitable synthetic plastic material. Bin A includes a rear wall 12 and opposite sidewalls 14 extending upwardly from a bottom wall 16. A slight draft angle of at least approximately one degree is provided on rear wall 12 and sidewalls 14 so that such walls slope outwardly. Thus, the interior area of bin A decreases slightly from the top toward the bottom thereof. A front wall 18 extends upwardly and outwardly from bottom wall 16 and terminates at a generally horizontal shelf 20 approximately midway between the top and bottom of bin A. A generally flat handle 22 extends downwardly and outwardly from shelf 20, and reinforcing webs 24 extend between such handle and front wall 18 beneath shelf 20. A pocket for retaining a generally rectangular identification card is provided on the outer surface of handle 22 by a card retaining member 28 which forms an upwardly opening groove for receiving the opposite side and bottom edges of an identification card.

Rear wall 12 and sidewalls 14 are stepped outwardly adjacent the top edges thereof to provide a rear support shoulder 30 and opposite side support shoulders 32. Upper rear wall portion 34 and upper sidewall portions 36 then extend vertically upward from such shoulders, and terminate at top edges 38 and 40.

A hook 44 extends downwardly beneath rear shoulder 30 in outwardly spaced relationship to rear wall 12 for suspending bin A from a frame. Reinforcing ribs 46 extend upwardly from rear shoulder 30 and inwardly from rear wall portion 34 to stiffen the rear portion of the bin against bending when it is suspended on a frame by hook 44. The terminal ends of ribs 46 which face toward the front of bin A may be considered to define inner rear stop surfaces which are abutted by the outer bottom portion of wall 12 on an upper bin when a plurality of such bins are stacked.

First abutment means in the form of projections 48 extend inwardly from sidewall portions 36 and are located intermediate shoulders 32 and top edges 40. Such projections have previously been provided on bins for retaining lids on such bins. A flat and rectangular lid member is supportable on shoulders 30 and 32, and fits between projections 48 and shoulders 32 so that projections 48 will retain the lid in position. In accordance with the present application, such projections 48 can also be used for retaining a lid on the bin. However, projections 48 in the bin of the present application also form abutment means for inhibiting forward sliding movement of an upper bin stacked upon a lower bin, and for inhibiting vertical separation of such stacked bins.

In view of the fact that sidewalls 14 slope outwardly, the width of bottom wall 16 would be less than the distance across side shoulders 32. Therefore, outwardly extending flanges 50 are provided along the full length of the bottom side edges of bin A. Such flanges 50 extend outwardly from sidewalls 14 in line with bottom wall 16. The distance across the outer edges of such flanges 50 is approximately the same as the distance across the inner surfaces of upper wall portions 36 above shoulders 32. An upper bin is then supportable along the full length of flanges 50 upon opposite side support shoulders 32. The thickness of flanges 50 is approximately the same as the distance between the undersurface of projections 48 and side shoulders 32.

Second abutment means in the form of projections 52 extend outwardly from sidewalls 14 adjacent flanges 50. In the arrangement shown, such projections 52 are generally vertically extending ribs which extend outwardly from sidewalls 14 approximately the same distance as flanges 50. The distance from the stop surface defined by the inner ends of ribs 46 to first abutment means 48 is approximately the same as the distance from the outer surface of rear wall 12 adjacent bottom wall 16 to the surface of second abutment means 52 which faces toward front wall 18.

When an upper bin is placed upon a lower bin, sidewall portions 36 will yield outwardly a sufficient amount so that flanges 50 can snap down beneath first abutment means 48. This will inhibit vertical separation of stacked bins. When an upper bin is stacked upon shoulders 32 of the lower bin, second abutment means 52 is also located closely adjacent first abutment means 48, and between such first abutment means 48 and rear wall 12 in order to inhibit forward sliding movement of the upper bin relative to the lower bin. Rear wall 12 will contact ribs 48 to inhibit rearward sliding movement of the upper bin relative to the lower bin.

With the arrangement shown and described, stacked bins are firmly held against movement relative to one another by cooperation of the first and second abutment means 48 and 52, along with location of flanges 50 beneath the first abutment means 48. When it is desired to use lids on the bins, they are held in position by the first abutment means 48 so that separate projections for lid retaining purposes and bin stacking purposes are unnecessary. In the preferred arrangement, projections 48 extend inwardly from sidewall portions 36 a distance slightly less than the width of side support shoulders 32.

It will be recognized that abutment means 48 and 52 can be located closer to rear wall 12 if so desired. Spaced-apart vertical ribs 56 are provided on the inner surfaces of sidewalls 14 to form grooves for receiving the opposite side edges of vertical divider strips for dividing the interior of a bin A into separate compartments if so desired.

Those portions of flanges 50 which are received beneath projections 48 may be considered generally horizontally extending abutment portions for inhibiting vertical separation of stacked bins.

Although the invention has been shown and described with reference to a preferred embodiment, it is obvious that equivalent alterations and modifications will occur to others skilled in the art upon the reading and understanding of this specification. The present invention includes all such equivalent alterations and modifications, and is limited only by the scope of the claims.

We claim:

1. A stackable bin including rear and sidewalls extending upwardly from a bottom wall and sloping slightly outwardly so that the interior size of said bin decreases slightly from the top toward the bottom thereof, outwardly extending flanges adjacent the bottom edges of said sidewalls extending along substantially the full length of said bin, said rear and sidewalls being stepped outwardly adjacent the top of said bin to provide support shoulders, the distance across said shoulders on said sidewalls being substantially the same as the distance between the outer edges of said flanges so that said flanges on an upper bin are supportable on said shoulders of a lower bin, projections extending inwardly from said sidewalls above said shoulders generally parallel thereto and in forwardly spaced relationship to said rear wall, generally vertical ribs extending outwardly from said sidewalls and upwardly from said flanges, said ribs on an upper bin stacked upon a lower bin being located closely adjacent said projections on the lower bin and between said rear wall and said projections on the lower bin to block forward sliding movement of the upper bin relative to the lower bin, and said flanges on the upper bin being received beneath said projections on the lower bin to block vertical separation of the bins, whereby the same said projections which cooperate with said ribs also cooperate with said flanges to perform the dual function of blocking vertical separation and forward sliding movement of an upper bin relative to a lower bin.

2. The bin of claim 1 wherein said projections extend inwardly from said sidewalls intermediate the top edges thereof and said shoulders.

* * * * *